US009598806B2

(12) United States Patent
Kinoshita et al.

(10) Patent No.: US 9,598,806 B2
(45) Date of Patent: Mar. 21, 2017

(54) AUTOMATED BOBBIN EXCHANGER DEVICE

(71) Applicant: Kinoshita Precision Industrial Co., Ltd., Aichi (JP)

(72) Inventors: Haruhiko Kinoshita, Aichi (JP); Sei Kato, Aichi (JP)

(73) Assignee: Kinoshita Precision Industrial Co., Ltd., Aichi (JP)

( * ) Notice: Subject to any disclaimer, the term of this patent is extended or adjusted under 35 U.S.C. 154(b) by 219 days.

(21) Appl. No.: 14/612,767

(22) Filed: Feb. 3, 2015

(65) Prior Publication Data

US 2016/0010253 A1 Jan. 14, 2016

(30) Foreign Application Priority Data

Jul. 8, 2014 (JP) ..... 2014-140309

(51) Int. Cl.
*D05B 59/04* (2006.01)
*D05B 57/26* (2006.01)

(52) U.S. Cl.
CPC ..... *D05B 59/04* (2013.01); *D05B 57/26* (2013.01); *D05D 2207/05* (2013.01)

(58) Field of Classification Search
CPC ..... D05B 59/04; D05B 57/14
USPC ..... 112/186, 180, 196, 228, 470.05; 242/473.5, 473.9
See application file for complete search history.

(56) References Cited

U.S. PATENT DOCUMENTS 3,376,838 A * 4/1968 Schiffmacher ..... D05B 59/04 112/180
4,186,677 A * 2/1980 Sacchetti ..... D05B 59/04 112/186
5,775,243 A * 7/1998 Kinoshita ..... D05B 59/04 112/186
6,041,725 A * 3/2000 Resta ..... D05B 59/04 112/180
6,170,417 B1 * 1/2001 Kinoshita ..... D05B 59/04 112/180

(Continued)

FOREIGN PATENT DOCUMENTS

JP H07-275552 A 10/1995
JP H08-196766 A 8/1996

(Continued)

OTHER PUBLICATIONS

Notice of Allowance issued in corresponding Japanese Patent Application No. 2014-140309 dated Feb. 10, 2015.

*Primary Examiner* — Tejash Patel
(74) *Attorney, Agent, or Firm* — Morgan, Lewis & Bockius LLP

(57) ABSTRACT

In an automated bobbin-exchanger device (3), a guide groove (6) which is provided on a vertical transfer base (5) has a horizontal portion (6*a*), a vertical portion (6*c*) and an arcuate portion (6*b*). A bobbin chuck (18) reciprocally moves pivotably along the guide groove (6) to make a travel distance minimum, thus enabling users to quickly exchange the bobbin case (12). By placing a bobbin holder (13*a*), a chuck-drive lever (14) and a chuck-drive air-cylinder (26) circumferentially, it is possible to make a whole structure compact and space-saving. The bobbin-exchanger device (3) requires only two bobbin cases (12) available to make their check and maintenance easy.

5 Claims, 11 Drawing Sheets

(56) References Cited

U.S. PATENT DOCUMENTS 6,286,444 B1 * 9/2001 Swaney ..... D05B 59/04
112/117

FOREIGN PATENT DOCUMENTS

| | | | | |
|---|---|---|---|---|
| JP | H08-280972 | A | 10/1996 | |
| JP | H09-066181 | A | 3/1997 | |
| JP | H09-299658 | A | 11/1997 | |
| JP | WO 2005087999 | A1 * | 9/2005 | ..... D05B 59/04 |

* cited by examiner

AUTOMATED BOBBIN EXCHANGER DEVICE

BACKGROUND OF THE INVENTION

Field of the Invention

The present invention relates to an automated bobbin-exchanger device which is capable of automatically exchanging a bobbin case when an under thread is entirely released from a bobbin and consumed in accompany with a stitching operation of a sewing machine.

Description of Related Art

In an industrial sewing machine, a bobbin case attached to a rotary hook accommodates a bobbin around which an under thread is wound. During a stitching operation of a sewing machine, clothes, fabrics or leather products are sewn up with the under thread and the upper thread in turn released from the bobbin and supplied from a sewing needle.

The bobbin accommodates the under thread, an amount of which is extremely small compared to that of the upper thread. Each time when the under thread is consumed, it becomes often necessary to take the bobbin case off from the rotary hook and exchange the bobbin with a new one full of under thread. Especially in an embroidery machine, there usually remains a limited space under the rotary hook. For this reason, a sewing operator often find it difficult to reach his or her hand for the rotary hook, thereby taking an extended time period to exchange the bobbin case so as to resultantly reduce a sewing efficiency. Efforts have been exerted to develop automated bobbin exchangers as represented by Japanese Laid-open Patent Application Nos. 8-196766, 8-280972 and 9-066181 (referred merely to as references hereinafter).

The bobbin exchangers that the above references have disclosed, have cammed grooves to guide the bobbin case between the rotary hook and a bobbin holder. The cammed grooves, however, are structurally complicated, thereby rendering the bobbin case to travel an extended distance. An air-cylinder provided to move a chuck along the cammed grooves, has to be located slantwise due to the complicated structure of the cammed grooves. This makes unavoidably to lengthen the horizontal and vertical distance so as to require an additional space.

On the contrary, there is only a limited space under the sewing table, especially under the rotary hook, thereby remaining a room to amelioration in making the bobbin exchanger into a compact and space-saving structure.

Therefore, the present invention has been made with the above drawbacks in mind, it is a main object of the invention to provide an automated bobbin exchanger device which is capable of minimizing a transfer distance that a bobbin case travels, thus enabling users to exchange the bobbin case quickly with a simplified structure, and resultantly making the bobbin exchanger into a compact and space-saving structure.

SUMMARY OF THE INVENTION

According to the present invention, there is provided an automated bobbin exchanger device in which a bobbin holder has a holder pin. To the holder pin, a single bobbin case is detachably secured which is made of a magnetic material. The bobbin holder is placed under a rotary hook in which a hook pin is provided. A vertical transfer base is placed to depend from a sewing table. A guide groove is provided as a cammed groove piercingly on the vertical transfer base. The guide groove has a horizontal portion, a vertical portion and an arcuate portion, the latter of which is in communication with a passage (interface) between the horizontal portion and the vertical portion.

A chuck-drive lever is pivotably provided by a pivot pin under the guide groove, and a leading end of the chuck-drive lever has a forked portion in which a chuck pin is slidably provided. The chuck pin passes through the guide groove, and the chuck-drive lever is arranged to pivotably rotate around the pivot pin so as to move the chuck pin reciprocally along the guide groove. A bobbin chuck is connected to the chuck pin and provided to detachably hold the bobbin case placed within the bobbin holder.

A chuck driver is placed to pivotably move the chuck-drive lever reciprocally around the pivot pin between a standby position, an exchangeable position and a middle position. The standby position places the chuck pin slidably within the vertical portion in which the bobbin chuck takes the bobbin case off from the bobbin holder. The exchangeable position places the chuck pin slidably within the horizontal portion to secure the bobbin case to the rotary hook. The middle position places the chuck pin slidably between the standby position and the exchangeable position.

A catch box is placed to correspond to the middle position, to which the chuck-drive lever pivotably moves. A chuck controller is provided to pivotably move the bobbin chuck from the middle position to the exchangeable position through the horizontal portion so as to take the bobbin case off from the rotary hook. Then, the bobbin chuck pivotably moves back to the middle position with the bobbin case attached, and detaching the bobbin case therefrom at the middle position to let the bobbin case fall into the catch box. Thereafter, the bobbin chuck pivotably moves further to the standby position through the vertical portion to take the bobbin case off from the bobbin holder and still further pivotably moving back to the exchangeable position through the arcuate portion and the horizontal portion so as to secure the bobbin case to the rotary hook before returning to the middle position through the horizontal portion.

A coiled body is secured to an inner wall of the catch box and energized when the bobbin chuck detaches the bobbin case at the middle position so as to attract the bobbin case toward the catch box by means of an electromagnetic force established when the coiled body is energized. A transfer air-cylinder is mounted on the vertical transfer base to move the catch box outside across the vertical transfer base along the crosswise direction after the bobbin chuck let the bobbin case fall into the catch box.

With the guide groove having the horizontal portion, the vertical portion and the arcuate portion, through which the bobbin chuck pivotably moves, it is possible to minimize a transfer distance that a bobbin case travels, thereby enabling users to exchange the bobbin quickly.

Additionally, it is possible to place the bobbin holder, the chuck-drive lever, the catch box, the chuck driver and the transfer air-cylinder circumferentially around the vertical transfer base. This makes it possible to simplify a whole structure, so as to resultantly make the bobbin exchanger into a compact and space-saving structure.

Regarding the bobbin accommodated by the bobbin case which the bobbin chuck detaches to let it fall into the catch box, the bobbin is replaced with a new one full of the under thread, and detachably secured to the holder pin of the bobbin holder. This needs to place the bobbin case at two sections, i.e., the holder pin and the rotary hook. Namely, this structure requires only two bobbin cases, thus making easy the check and maintenance that the expensive bobbin cases need.

When the bobbin chuck pivotably moves to the middle position from the exchangeable position so as to release the bobbin case toward the catch box, the coil body is energized to establish the electromagnetic force. Because the bobbin case is made of the magnetic material, the electromagnetic force exerts the bobbin case to attract the bobbin case to let it fall into the catch box without let and hindrance.

With the transfer air-cylinder actuating the catch box to move the bobbin case outside the sewing table, it is possible for the users to easily reach their hand for the bobbin case, so that the users can take the bobbin case from the catch box so as to replace the bobbin with a new one full of under thread.

According to other aspect of the present invention, the bobbin case has an elastic lock lever movably provided by means of a chuck air-cylinder. The bobbin chuck has a chuck pawl removably engaged with the lock lever to detachably hold the bobbin case.

With the chuck pawl removably engaged with the lock lever, it is possible to detachably mount the bobbin case on the bobbin chuck with a simplified structure.

According to other aspect of the present invention, the vertical transfer base secures a drive air-cylinder which has a rod movably provided to protract and retract. The drive air-cylinder is arranged to protract the rod to engage with one side of the chuck-drive lever to prevent the chuck-drive lever from inadvertently shifting toward the standby position when the bobbin chuck returns to the middle position from the exchangeable position after securing the bobbin case to the rotary hook.

With the chuck-drive lever prevented from moving pivotably toward the standby position, it is possible to lock the chuck-drive lever at the middle position to block the chuck-drive lever from inadvertently shifting toward the standby position even when the chuck-drive lever is subjected to an exterior force.

According to other aspect of the present invention, the vertical transfer base has a rod movably provided to protract and retract by means of a drive air-cylinder and the chuck-drive lever has a stopper hole. The drive air-cylinder is arranged to protract the rod to engage with the stopper hole, so as to prevent the chuck-drive lever from inadvertently shifting toward the standby position when the bobbin chuck returns to the middle position from the exchangeable position after securing the bobbin case to the rotary hook.

With the chuck-drive lever prevented from shifting pivotably toward both the standby and exchangeable positions, it is possible to lock the chuck-drive lever at the middle position even when the chuck-drive lever is subjected to an exterior force.

According to other aspect of the present invention, the chuck-drive lever has an open-ended groove in a lengthwise direction. The groove has an inner side, along which the chuck pin is slidably arranged.

With the open-ended groove provided on the chuck-drive lever, it is possible to place the chuck pin on the chuck-drive lever with a simplified structure.

BRIEF DESCRIPTION OF THE DRAWINGS

A preferred form of the present invention is illustrated in the accompanying drawings in which.

DETAILED DESCRIPTION OF PREFERRED EMBODIMENTS

Figure 1:
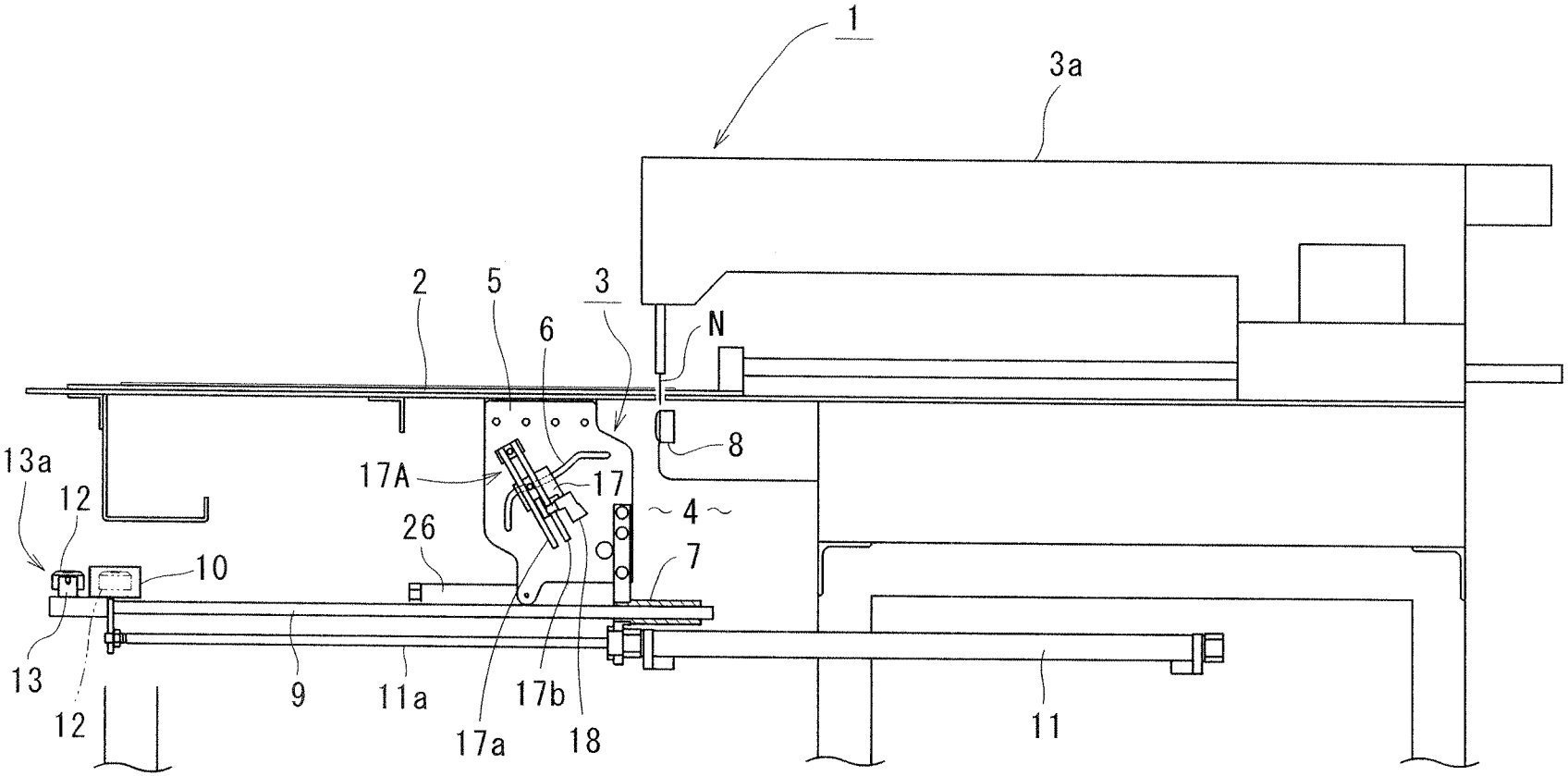
FIG. 1 is a schematic view of a sewing machine in which an automated bobbin exchanger device is provided according to a first embodiment of the invention.

In the following description of the depicted embodiments, the same reference numerals are used for features of the same type.

Figure 2:
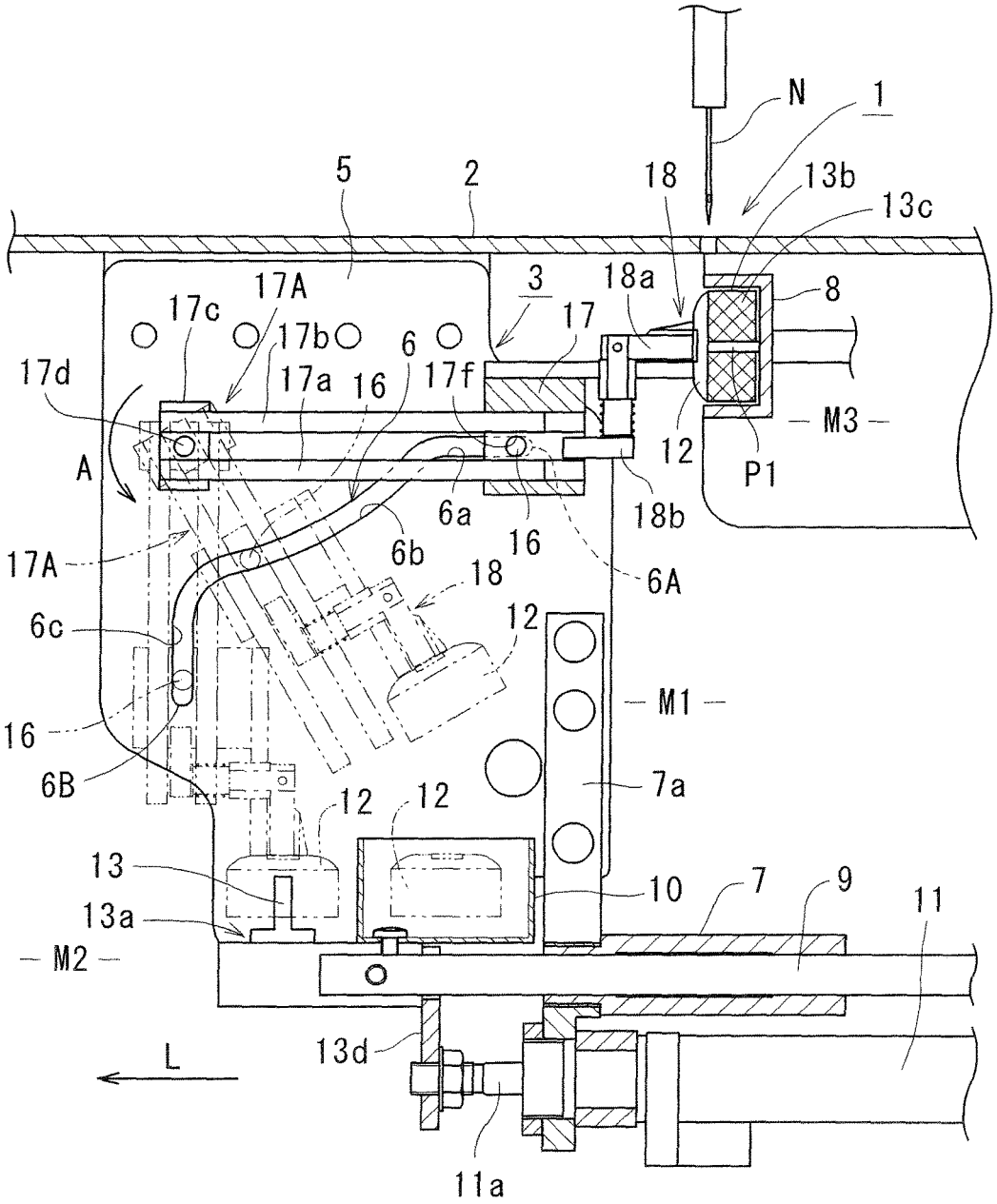
FIG. 2 is a longitudinal cross sectional view of the automated bobbin exchanger device.

Referring to FIGS. 1 through 12 which show an automated bobbin exchanger device and its related structures according to a first embodiment of the invention, a sewing machine 1 has a sewing head 3*a*, a sewing needle (N) and a sewing table 2 as shown in FIGS. 1 and 2. Under the sewing table 2, there is provided an available space 4 in which the automated bobbin exchanger device 3 is provided to have a vertical transfer base 5 depended from the sewing table 2 in perpendicular to a base plate (not shown) of the bobbin exchanger device 3. The vertical transfer base 5 has a guide groove 6 provided as a cammed groove piercingly. The guide groove 6 has a horizontal portion 6*a*, a vertical portion 6*c* and an arcuate portion 6*b*. The arcuate portion 6*b* is gradually curved to be in communication with a passage (interface) between the horizontal portion 6*a* and the vertical portion 6*c*.

The horizontal portion 6*a* is arranged to be somewhat longer than a drawing length of a hook pin P1, to which a rotary hook 8 is secured. The vertical portion 6*c* is determined to be slightly longer than a drawing length of a holder pin 13 which is to be described in detail hereinafter. A bobbin case 12 which accommodates a bobbin 13*b* is made of a magnetic material, and arranged to be detachably or removably received by the hook pin P1 of the rotary hook 8.

An angle at the circumference is determined to be 90±5 degrees between an opened end 6A of the horizontal portion 6*a* and an opened end 6C of the vertical portion 6*c*. At a lower end of the vertical transfer base 5, as shown in FIG. 2, a guide holder 7 is horizontally provided under the rotary hook 8 by means of a vertical fixing tool 7*a*.

An elongate guide bar 9 is slidably arranged on the guide holder 7 so as to reciprocally move in an axial direction. The guide bar 9 has a distal end on which a catch box 10 is located to correspond to a middle position M1 so as to receive the bobbin case 12 detached by a bobbin chuck 18 as described in detail hereinafter.

Immediately under the guide holder 7, a transfer air-cylinder 11 is provided by means of the vertical fixing tool 7*a*. The transfer air-cylinder 11 has a rod 11*a* connected to the guide bar 9 through a connector block 13*d* (refer to FIG. 9). Upon driving the transfer air-cylinder 11, the rod 11*a* is protracted to carry the catch box 10 outside across the vertical transfer base 5 along a crosswise direction L. This makes it possible for users to easily reach their hand for the bobbin case 12 and take off the bobbin 13*b* from the bobbin case 12 so as to replace the bobbin 13*b* with a new one full of an under thread 13*c*.

Figure 9:
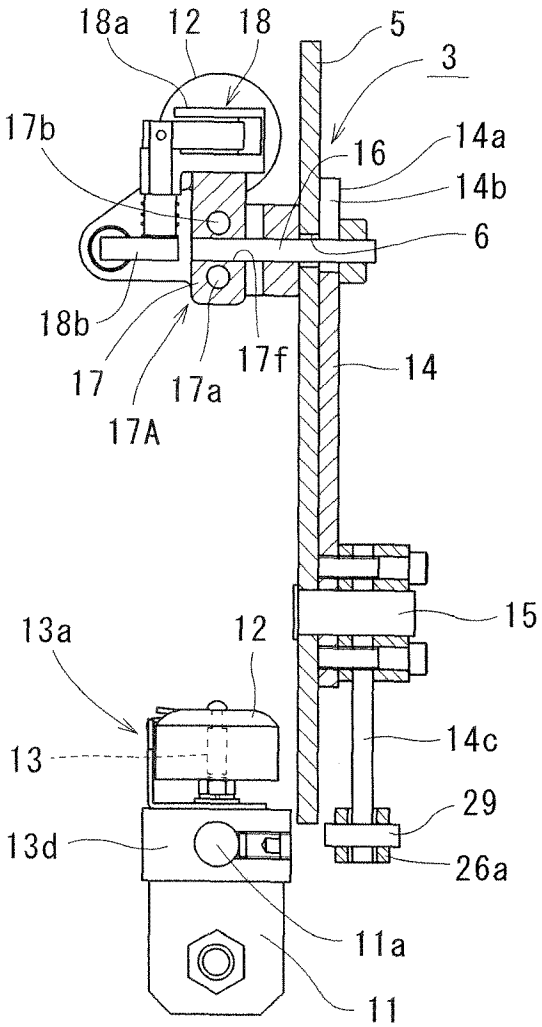

As shown in FIG. 9, a bobbin holder 13*a* is provided by means of the connector block 13*d* to correspond to a standby position M2 under the vertical transfer base 5. The bobbin holder 13*a* has a holder pin 13, to which the single bobbin case 12 is detachably secured. The bobbin holder 13*a* is located under the rotary hook 8, to which the hook pin (P1) is secured. The bobbin case 12 is detachably accommodates the bobbin 13*b* in which the under thread 13*c* is provided. The bobbin case 12 is arranged to be temporarily taken out from the catch box 10 so as to replenish the under thread 13*c* with the bobbin 13*b*.

Figure 3:
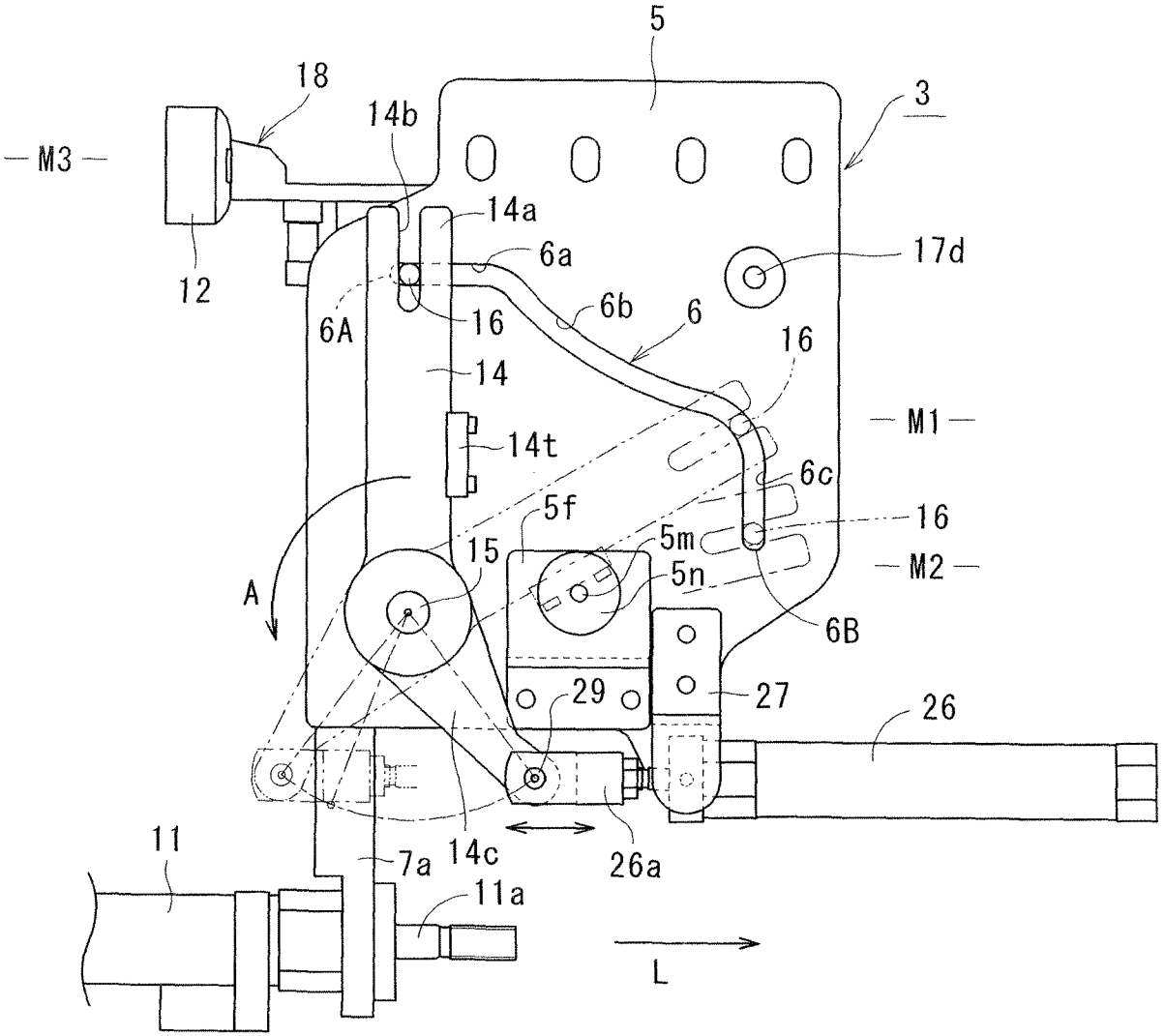
FIG. 3 is a plan view of the automated bobbin exchanger device looked from a reverse side of FIG. 2.

As shown in FIG. 3, a chuck-drive lever 14 is pivotably provided around a pivot pin 15 under the guide groove 6 and adapted to be driven together with a bobbin chuck 18 by means of a chuck-drive air-cylinder 26 (chuck driver). On a basal end of the chuck-drive lever 14, integrally provided is a driver arm 14*c*, to which the chuck-drive air-cylinder 26 connects the rod 26*a* by means of a connector pin 29. A leading end of the chuck-drive lever 14 forms a forked portion 14*a* in which a chuck pin 16 slidably provided to be sandwiched between forked pieces of the forked portion 14*a*. Namely, the leading end of the chuck-drive lever 14 has an elongate notch 14*b* as an open-ended groove to form the forked portion 14*a* in a U-shaped configuration. The chuck pin 16 is connectedly placed to reciprocally slide along an inner side of the elongate notch 14*b* in a lengthwise direction.

The forked portion 14*a* works as an allowance for the chuck pin 16 during which the chuck pin 16 pivotably moves from the horizontal portion 6*a* to the arcuate portion 6*b* and vice versa. Namely, upon moving the chuck pin 16 pivotably to the arcuate portion 6*b*, the forked portion 14*a* allows redundant shift of the chuck pin 16, i.e., a diametrical difference between the horizontal portion 6*a* and the arcuate portion 6*b*. This also makes it possible to smoothly move the chuck pin 16 from the arcuate portion 6*b* to the vertical portion 6*c* and vice versa.

Figure 4:
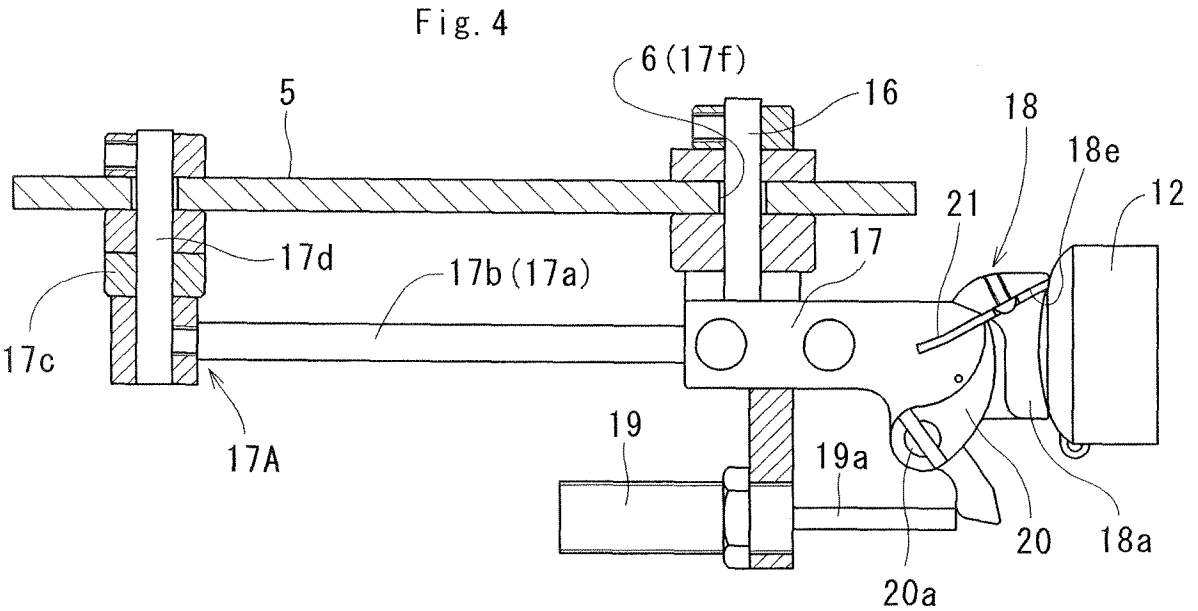
FIGS. 4 and 5 are longitudinal cross sectional views of a position-changing lever looked from different directions.
Figure 5:
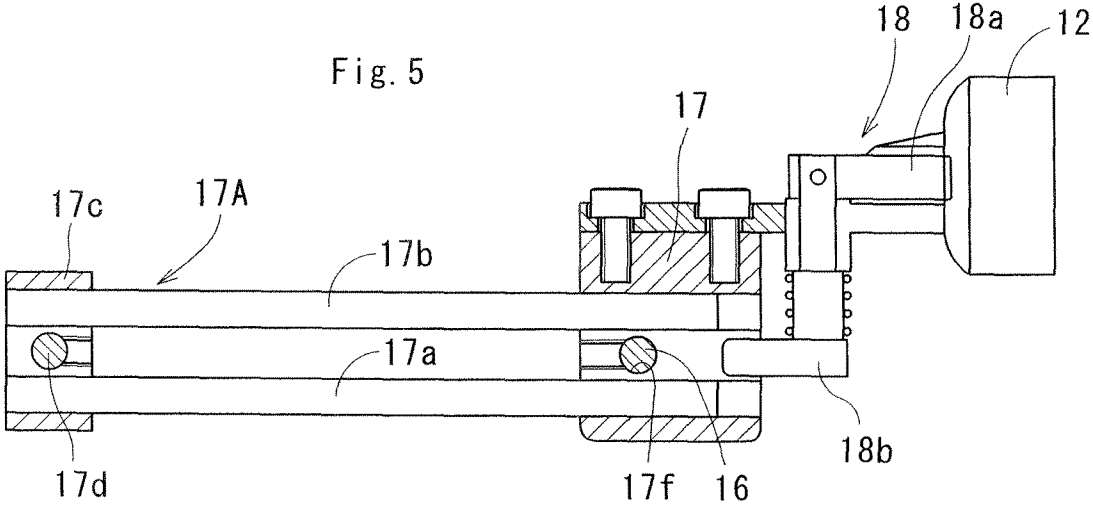

The chuck pin 16 has an end portion opposite to the chuck-drive lever 14 as shown in FIG. 2. To the end portion of the chuck pin 16, the bobbin chuck 18 is connected by way of a mount base 17. As also shown in FIGS. 4 and 5, the bobbin chuck 18 has a bobbin head 18*a* placed to correspond to the rotary hook 8, and further having a leg portion 18*b* fixedly connected to the mount base 17.

Through the mount base 17, parallel pins 17*a*, 17*b* are slidably pierced to constitute a position-changing lever 17A which makes the mount base 17 reciprocally slide along the parallel pins 17*a*, 17*b* in an axial direction.

Each of the parallel pins 17*a*, 17*b* has one end rotationally connected to a support pin 17*d* via a fixing plate 17*c*, and having other end fixedly connected to the bobbin chuck 18 via the mount base 17. This makes it possible to pivotably rotate the parallel pins 17*a*, 17*b* around the support pin 17*d* because the support pin 17*d* permits the parallel pins 17*a*, 17*b* to move in the right-to-left and up-to-down directions. The bobbin chuck 18 allows the bobbin head 18*a* to move together with the fixing plate 17*c* reciprocally along the parallel pins 17*a*, 17*b* in the axial direction. The mount base 17 has an insert hole 17*f* which permits an entry of the chuck pin 16.

Figure 7:
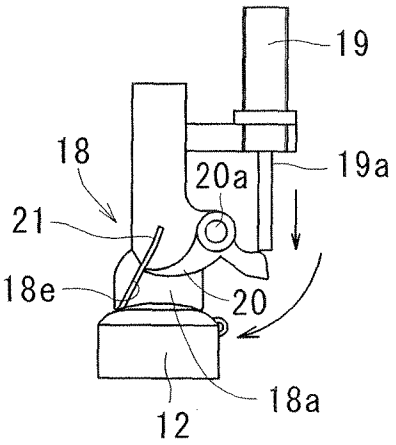
FIGS. 7 and 8 are plan views of a chuck air-cylinder depicted to explain how the chuck air-cylinder works.
Figure 8:
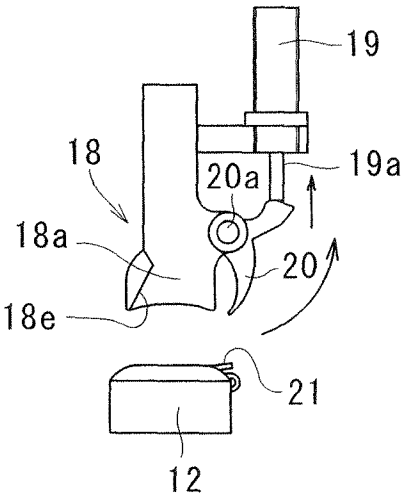
Figure 6:
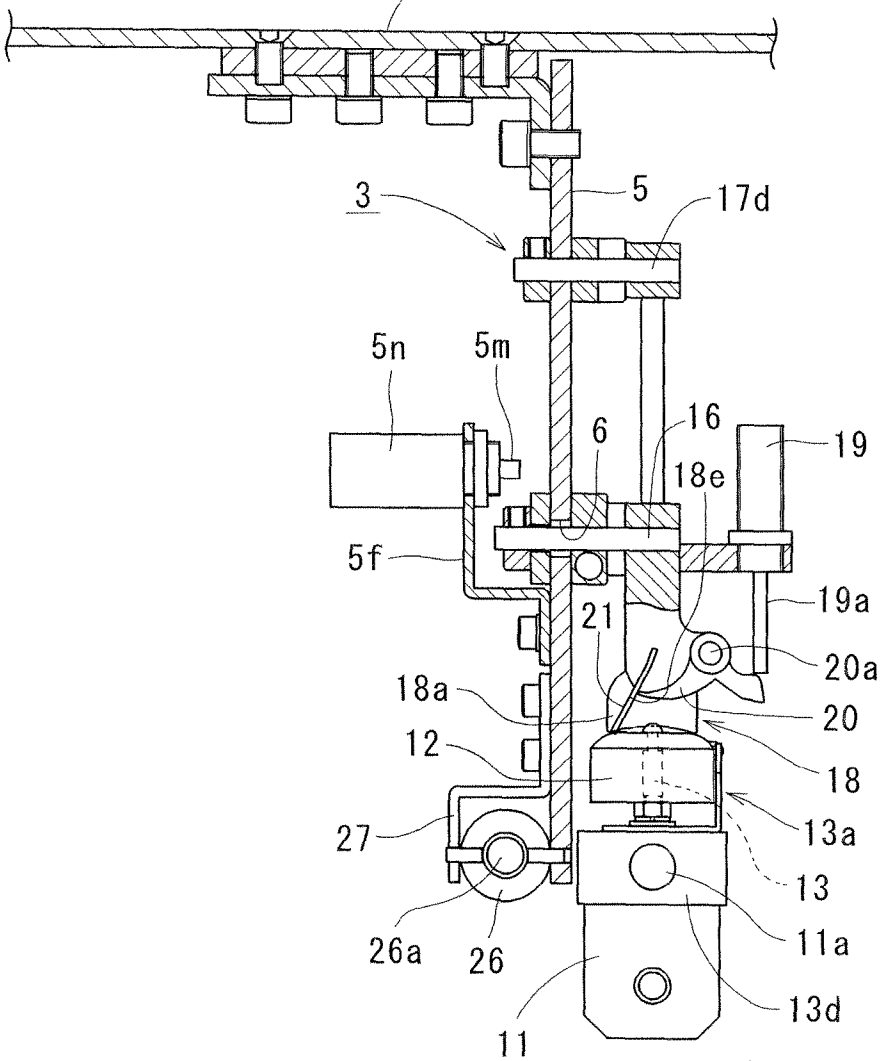
FIG. 6 is a longitudinal cross sectional view of the automated bobbin exchanger device.
Figure 10:
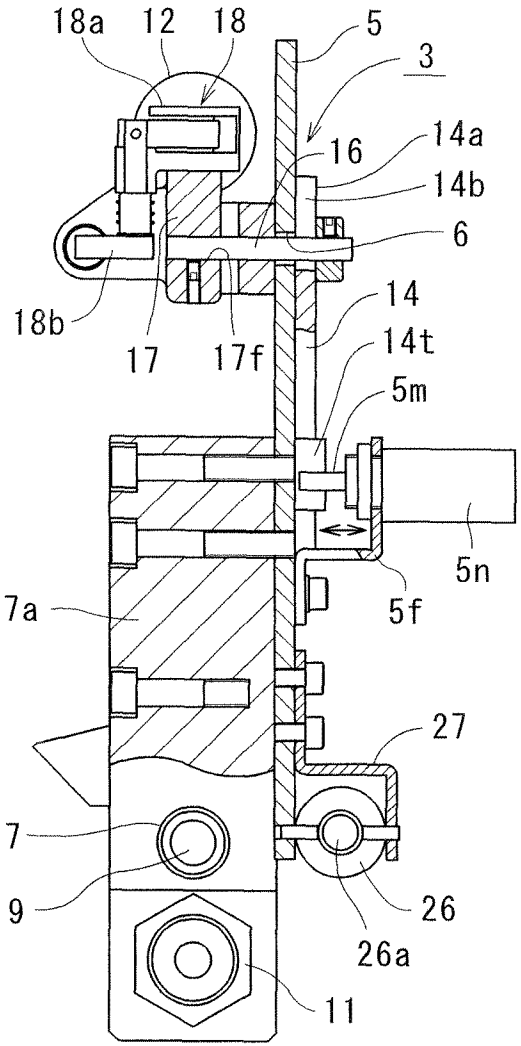
FIGS. 9 and 10 are longitudinal cross sectional views of the automated bobbin exchanger device sectioned from different perspectives.

As shown in FIGS. 6-8, the bobbin chuck 18 has a chuck pawl 20 removably engaged with an elastic lock lever 21 to detachably hold or retain the bobbin case 12 when a chuck air-cylinder 19 is actuated. Namely, upon actuating the chuck air-cylinder 19, the chuck air-cylinder 19 advances the rod 19*a* to rotate the chuck pawl 20 around an axis pin 20*a* in the clockwise direction as shown in FIGS. 6 and 7.

Because the bobbin case 12 allows the elastic lock lever 21 to rise and lie down around a pivot neck, the lock lever 21 is brought into engagement with the chuck pawl 20 to rise it up, so that the lock lever 21 abuts against a halfway wall 18*e* of the bobbin head 18*a* when the chuck pawl 20 rotates in the clockwise direction.

This makes it possible to accurately determine a connecting position in which the bobbin head 18*a* is normally connected to the bobbin case 12.

Such is the structure that it becomes possible to prevent the connecting position from being shifted when subjected to an exterior force upon pivotably moving the bobbin case 12.

Upon connecting the bobbin head 18*a* to the bobbin case 12, if any variation or fluctuation would occur even slightly, it would hinder the bobbin case 12 from maintaining a transfer precision against the rotary hook 8. The transfer precision has a tolerance within ±0.1 mm.

In order to maintain the transfer precision, playing an important role are the bobbin head 18*a*, the lock lever 21 and the halfway wall 18*e*.

When the chuck air-cylinder 19 retracts the rod 19*a* as shown in FIG. 8, the lock lever 21 rotates the chuck pawl 20 due to the elastic force around the axis pin 20*a* in the counterclockwise direction so as to return to the original position. This permits the lock lever 21 to disengage from the bobbin head 18*a* so as to detach the bobbin chuck 18 from the bobbin case 12. Because the bobbin chuck 18 has the chuck pawl 20 which detachably engaged with the bobbin case 12, it is possible to removably secure the bobbin case 12 against the bobbin chuck 18 with a simplified structure.

To a lower end of the vertical transfer base 5, the chuck-drive air-cylinder 26 is horizontally provided as a chuck driver by means of a bracket 27 as shown in FIG. 3. The chuck-drive air-cylinder 26 has a rod 26*a* pivotably connected to the driver arm 14*c* of the chuck-drive lever 14 by way of the connector pin 29. The chuck-drive lever 14 is arranged to be normally located at the middle position M1 as shown at phantom line in FIG. 2. To the vertical transfer base 5, a drive air-cylinder 5*n* is secured by way of a securement arm 5*f* as shown in FIG. 3 (also see FIG. 10).

When the bobbin chuck 18 secures the bobbin case 12 to the rotary hook 8 at the exchangeable position M3 and return to the middle position M1, the drive air-cylinder 5*n* protracts the rod 5*m* to engage with one side of the chuck-drive lever 14 via a cushion pad 14*t* at a side corresponding to the standby position M2. The cushion pad 14*t* is secured to a outer side of chuck-drive lever 14 to serve as a shock-absorbing material. With the rod 5*m* engaged with the chuck-drive lever 14, it is possible to prevent the chuck-drive lever 14 from inadvertently shifting toward the standby position M3 when subjected to an exterior force upon returning the bobbin chuck 18 to the middle position M1 after securing the bobbin case 12 to the rotary hook 8.

When the bobbin 13*b* consumed its thread 13*c* in accompany with prolonged operation of the sewing machine 1, a thread sensor (not shown) works to cease the operation of the sewing machine 1. At this time, the drive air-cylinder 5*n* retracts the rod 5*m* to disengage from the chuck-drive lever 14. In accompany with the cease of the sewing machine 1, a chuck control diagram (a)-(e) acts as a chuck controller to control the pivotal or rotational movement of the chuck-drive lever 14 as shown in Table 1 (also see FIGS. 11 and 12).

TABLE 1

| Chuck Control Diagram |
|---|
| (a) Rotational Direction |
| Middle Position M1⇒Exchangeable Position M3 |
| ⇓ |
| Chuck-drive Air-cylinder 26 |
| ⇓ |
| Actuating Rod 26a-For Predetermined Time Period |
| ⇓ |
| Retracting Rod 26a Rearward |
| (b) Rotational Direction |
| Exchangeable Position M3⇒Middle Position M1 |
| ⇓ |
| Chuck-drive Air-cylinder 26 |
| ⇓ |
| Actuating Rod 26a For Predetermined Time Period |
| ⇓ |
| Protracting Rod 26a forward |
| (c) Rotational Direction |
| Middle Position M1⇒Standby Position M2 |
| ⇓ |
| Chuck-drive Air-cylinder 26 |
| ⇓ |
| Actuating Rod 26a For Predetermined Time Period |
| ⇓ |
| Protracting Rod 26a forward |
| (d) Rotational Direction |
| Standby Position M2⇒Exchangeable Position M3 |
| ⇓ |
| Chuck-drive Air-cylinder 26 |
| ⇓ |
| Actuating Rod 26a For Predetermined Time Period |
| ⇓ |
| Retracting Rod 26a Rearward |
| (e) Rotational Direction |
| Exchangeable Position M3⇒Middle Position M1 |
| ⇓ |
| Chuck-drive Air-cylinder 26 |
| ⇓ |
| Actuating Rod 26a For Predetermined Time Period |
| ⇓ |
| Protracting Rod 26a forward |

With the actuation of the position-changing lever 17A, the actuation pivotably moves the bobbin chuck 18 to the exchangeable position M3 from the middle position M1. After taking the bobbin case 12 off from the rotary hook 8, the bobbin chuck 18 returns to the middle position M1 to let the bobbin case 12 fall into the catch box 10. After letting the bobbin case 12 fall, the bobbin chuck 18 pivotably moves back to the standby position M2 to take a new bobbin case 12 off from the holder pin 13 of the bobbin holder 13*a*. After taking the bobbin case 12 as the new one full of the under thread 13*c*, the bobbin chuck 18 pivotably moves to the exchangeable position M3 from the standby position M2.

At the exchangeable position M3, the bobbin chuck 18 secures the bobbin case 12 detachably to the hook pin P1 of the rotary hook 8. After securing the bobbin case 12 to the rotary hook 8, the bobbin chuck 18 returns to the middle position M1 from the exchangeable position M3.

Figure 11:
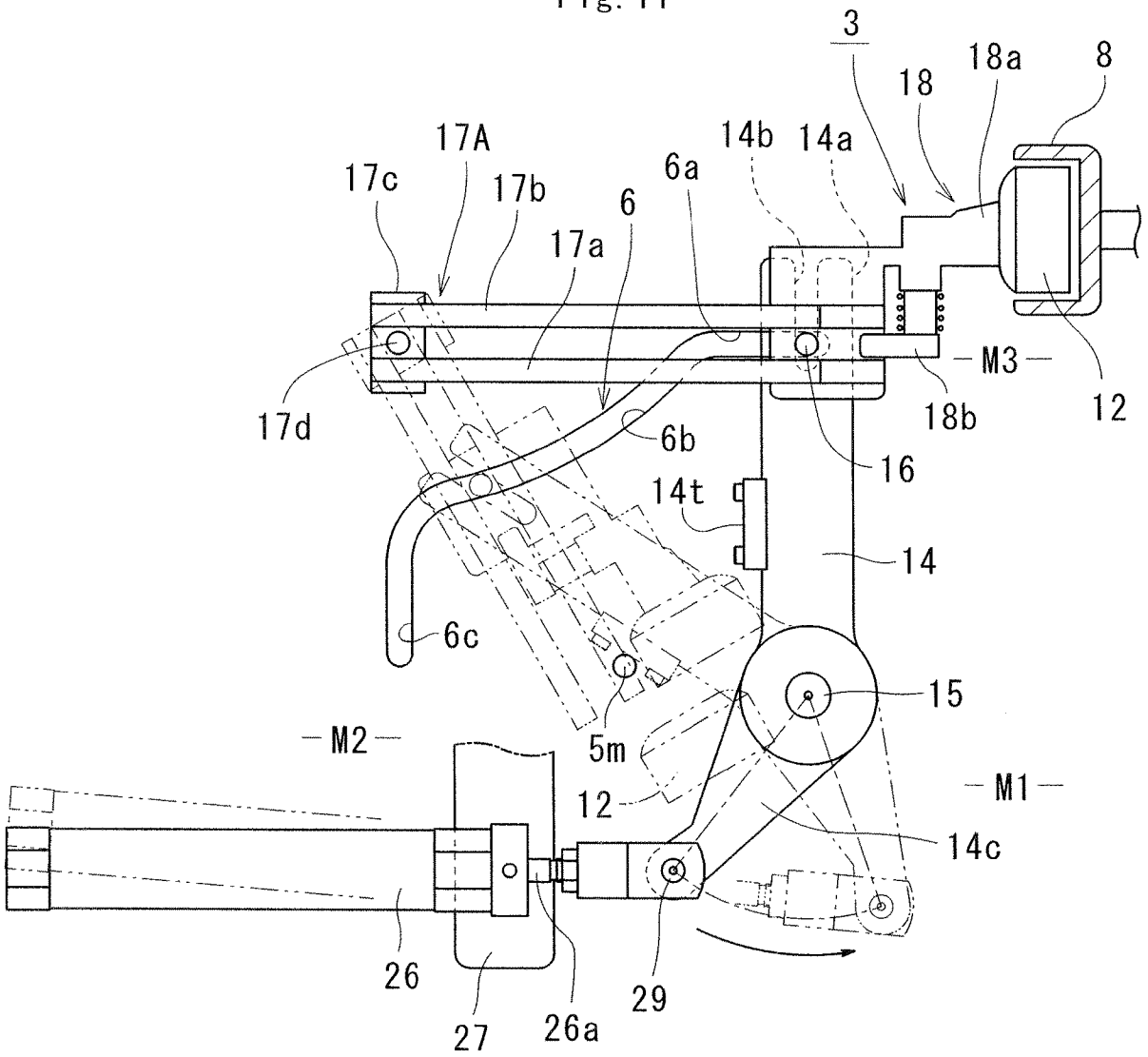
FIG. 11 is a schematic view of the automated bobbin exchanger device.
Figure 12:
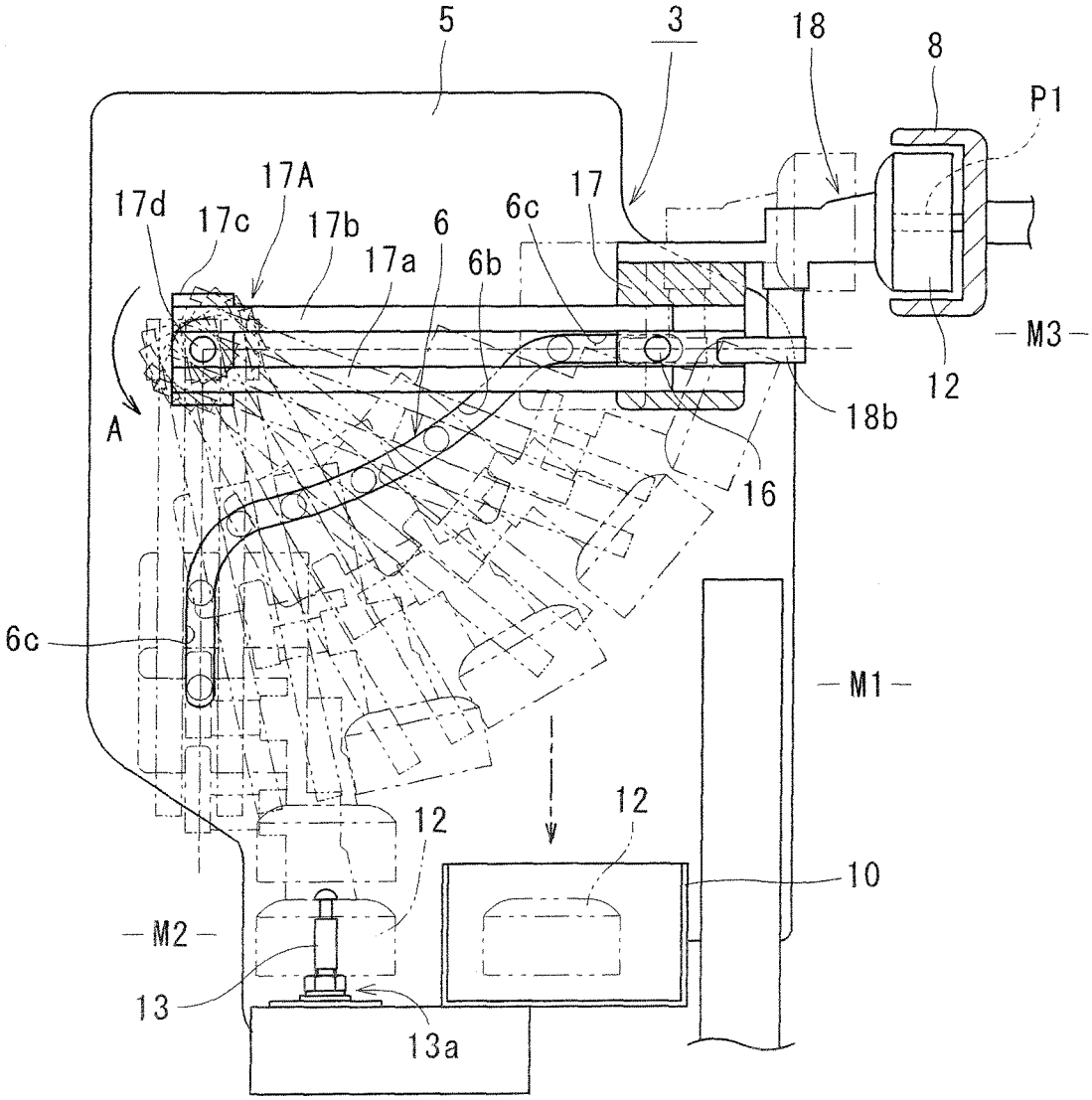
FIG. 12 is a schematic view depicted how a bobbin case pivotably moves along a guide groove in sequence.

Referring to the chuck control diagram (a)-(e) and FIGS. 11, 12, the rotational or pivotal movement of the bobbin chuck 18 (middle position M1⇒ exchangeable position M3 ⇒ middle position M1⇒ standby position M2⇒ exchangeable position M3⇒ middle position M1) is described in detail as follows.

Upon ceasing the operation of the sewing machine 1 by means of the thread sensor, the chuck-drive air-cylinder 26 is actuated to retract the rod 26*a* so as to rotate the chuck-drive lever 14 around the pivot pin 15 in the direction of arrow A in FIG. 2. This makes the chuck pin 16 slide from the arcuate portion 6*b* to the horizontal portion 6*a* so as to pivotably move the chuck-drive lever 14 to the exchangeable position M3 as shown at solid line in FIG. 2.

At the exchangeable position M3, the position-changing lever 17A moves fully around the support pin 17*d* in the counterclockwise direction. In accompany with the chuck pin 16 slid from the arcuate portion 6*b* to the horizontal portion 6*a*, the bobbin chuck 18 engages the bobbin head 18*a* with a head of the bobbin case 12.

In this situation, the chuck air-cylinder 19 is actuated to pivotably move the chuck pawl 20 around the axis pin 20*a* in the clockwise direction as shown in FIGS. 6-8. This makes the chuck pawl 20 engage with the lock lever 21 to rotationally rise up the lock lever 21, so that the lock lever 21 abuts against the halfway wall 18*e* of the bobbin head 18*a* so as to detachably connect the bobbin chuck 18 to the bobbin case 12.

Thereafter, the chuck-drive air-cylinder 26 is actuated to protract the rod 26*a* so as to rotate the chuck-drive lever 14 around the pivot pin 15 in the direction opposite to the arrow A in FIG. 2. This makes the chuck pin 16 slide from the horizontal portion 6*a* to the arcuate portion 6*b* so as to pivotably move the chuck-drive lever 14 to the middle position M1 as shown at the phantom line in FIG. 2.

During the process in which the chuck pin 16 slides along the horizontal portion 6*a*, the bobbin case 12 moves away from the hook pin P1 of the rotary hook 8, so that the bobbin chuck 18 reaches the arcuate portion 6*b* with the bobbin case 12 attached.

At this time, the chuck air-cylinder 19 is actuated to retract the rod 19*a*, so that the lock lever 21 rotationally turns by its elastic force to makes the chuck pawl 20 pivot in the counterclockwise direction to set the bobbin case 12 free. This makes the lock lever 21 disengage from the bobbin head 18*a*, so that the bobbin chuck 18 detaches the bobbin case 12 and releases the bobbin case 12. This means that the bobbin chuck 18 detaches the bobbin case 12 to let the bobbin case 12 fall into the catch box 10.

With the chuck-drive air-cylinder 26 further protracting the rod 26*a*, the chuck-drive lever 14 pivotably moves to the standby position M2 from the middle position M1 as shown by dot-dash lines in FIG. 3. In accompany with the movement of the chuck-drive lever 14, the chuck pin 16 slides from the arcuate portion 6*b* to the vertical portion 6*c*, so that the position-changing lever 17A pivotably moves around the support pin 17*d* in the clockwise direction so as to arrive at the standby position M2.

In this situation, the bobbin chuck 18 engages the bobbin head 18*a* with the head of the bobbin case 12 accommodated by the bobbin holder 13*a*. This actuates the chuck air-cylinder 19 to rotate the chuck pawl 20 around the axis pin 20*a* in the clockwise direction, so that the bobbin chuck 18 connects the bobbin case 12 in the same manner as mentioned above.

When the bobbin chuck 18 connects the bobbin case 12, the chuck-drive air-cylinder 26 further retracts the rod 26*a*, so that the chuck-drive lever 14 pivotably moves around the pivot pin 15 in the direction as shown by the arrow A in FIG. 2. In accompany with the pivotal movement of the chuck-drive lever 14, the chuck pin 16 slides to the horizontal portion 6*a* from the vertical portion 6*c* through the arcuate portion 6*b*. This makes the position changing lever 17A rotate to the exchangeable position M3 from the standby position M2 through the middle position M1 with the bobbin case 12 attached. At the exchangeable position M3, the bobbin case 12 moves to the hook pin P1 and detachably secured by the rotary hook 8. This makes it possible automatically to replace the bobbin case 12 held by the rotary hook 8 with the new one accommodated by the bobbin holder 13*a*.

Thereafter, the chuck air-cylinder 19 is actuated to retract the rod 19*a*, so that the lock lever 21 lies down on the bobbin case 12 by the elastic force so as to rotate the chuck pawl 20 in the counterclockwise direction. This detaches the bobbin case 12 and releases it from the bobbin chuck 18 to set the bobbin case 12 free.

After detaching the bobbin case 12, the chuck-drive air-cylinder 26 advances the rod 26*a*, so that the chuck-drive lever 14 pivotably moves around the pivot pin 25 in the direction opposite to the arrow A in FIG. 2. This makes the bobbin chuck 18 move away from the bobbin case 12 secured by the rotary hook 8. In combination with the movement of the bobbin chuck 18, the position-changing lever 17A returns to the middle position M1 from the exchangeable position M3, so that the bobbin chuck 18 is located to corresponds to the catch box 10. At this moment, the drive air-cylinder 5*n* is actuated to protract the rod 5*m*, so that the rod 5*m* is brought into engagement with the chuck-drive lever 14 through the cushion pad 14*t*, thereby preventing the chuck-drive lever from inadvertently shifting toward the standby position M2.

At the exchangeable position M3 in which the bobbin case 12 is secured detachably to the rotary hook 8, a thread-exchange sensor (not shown) works to resume the operation of the sewing machine 1.

When the bobbin chuck 18 detaches the bobbin case 12 to let it into the catch box 10, a proximity sensor (not shown) detects the bobbin case 12 fallen into the catch box 10 to actuate the transfer air-cylinder 11. Then, the transfer air-cylinder 11 extends its elongate rod 11*a* to move the guide bar 9 from the middle position M1 along the guide holder 7 in the lengthwise direction. This carries the catch box 10 to move across the vertical transfer base 4 outside along the crosswise direction L, for which the users can easily reach their hand. It is to be noted that the transfer air-cylinder 11 may be actuated before or after the sewing machine 1 resumes its operation, instead of the time when the bobbin chuck 18 lets the bobbin case 12 fall into the catch box 10.

When the catch box 10 is carried outside, the bobbin case 12 is taken out of the catch box 10 to replenish the bobbin 13*b* with the under thread 13*c*, which means to replace the bobbin 13*b* with the new one full of the under thread 13*c*. The bobbin case 12 which accommodates the newly replaced bobbin 13*b*, is secured to the bobbin holder 13*a* by inserting it into the holder pin 13. Then, the transfer air-cylinder 11 protracts the rod 11*a* to move back the guide bar 9 along the guide holder 7 in the lengthwise direction so as to return to the middle position M1.

With the structure thus described, the guide groove 6 has the horizontal portion 6*a*, the vertical portion 6*b* and the arcuate portion 6*c*, through which the bobbin chuck 18 pivotably moves by means of the chuck pin 16, it is possible to minimize a transfer distance that a bobbin case 12 travels, thus enabling the users to exchange the bobbin 13*b* quickly.

Additionally, it is possible place the bobbin holder 13*a*, the chuck-drive lever 14, the catch box 10, the chuck-drive air-cylinder 26 and the transfer air-cylinder 11 circumferentially around the vertical transfer base 5. This makes it possible to simplify a whole structure, so as to resultantly make the bobbin exchanger into a compact and space-saving structure.

Regarding the bobbin 13*b* accommodated by the bobbin case 12 which the bobbin chuck detaches to let it fall into the catch box 10, the bobbin 13*b* is replaced with a new one full of the under thread 13*c*, and detachably secured to the holder pin 13 of the bobbin holder 13*a*. This needs to place the bobbin case 12 at two sections, i.e., the holder pin 13 and the rotary hook 8. Namely, this structure requires only two bobbin cases, thus making easy the check and maintenance that the expensive bobbin cases 12 need.

Figure 13:
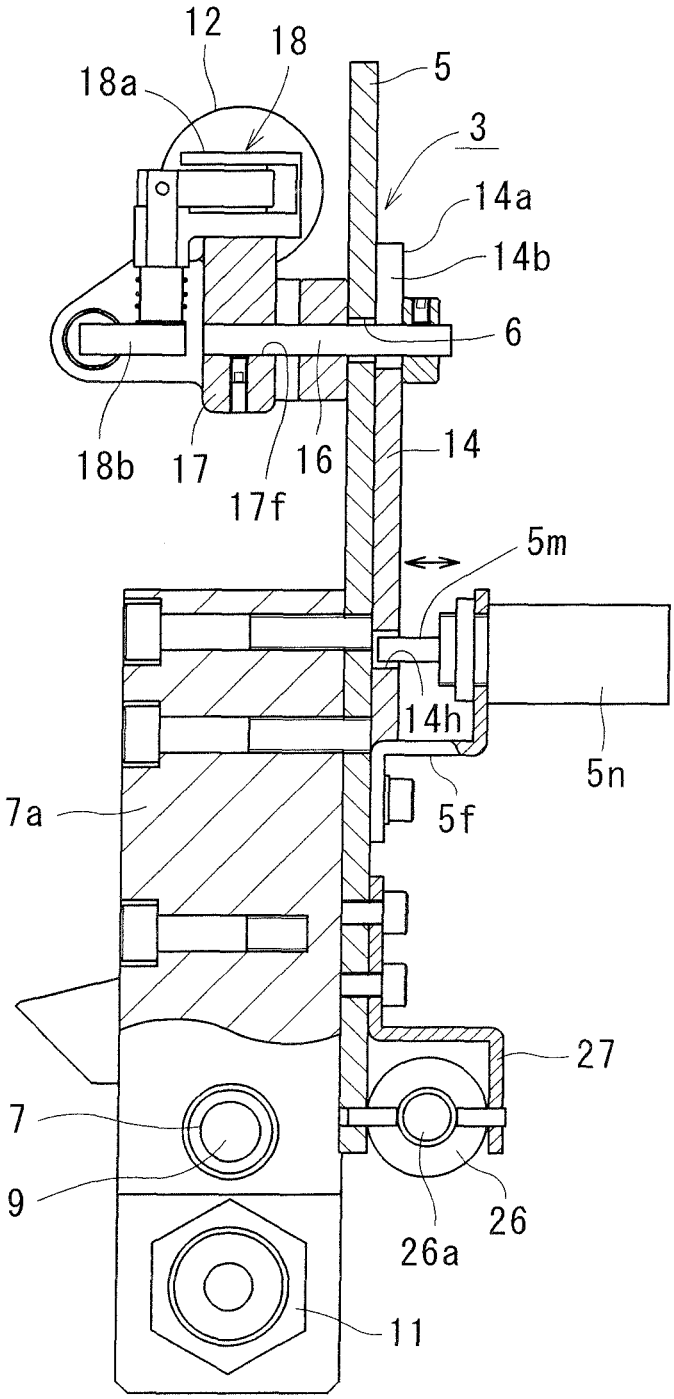
FIG. 13 is a longitudinal cross sectional view of the automated bobbin exchanger device according to a second embodiment of the invention.

FIG. 13 shows a second embodiment of the invention in which the chuck-drive lever 14 has a stopper hole 14*h*, a location of which corresponds to the rod 5*m* of the drive air-cylinder 5*n*.

When the bobbin chuck 18 pivotably returns to the middle position M1 from the exchangeable position M3 after securing the bobbin case 12 to the rotary hook 8, a position-detecting sensor (not shown) works to actuate the drive air-cylinder 5*n* to protract the rod 5*m* to engage with the stopper hole 14*h*. This prevents the chuck-drive lever 14 from inadvertently shifting toward both the standby and exchangeable positions M2, M3.

Figure 14:
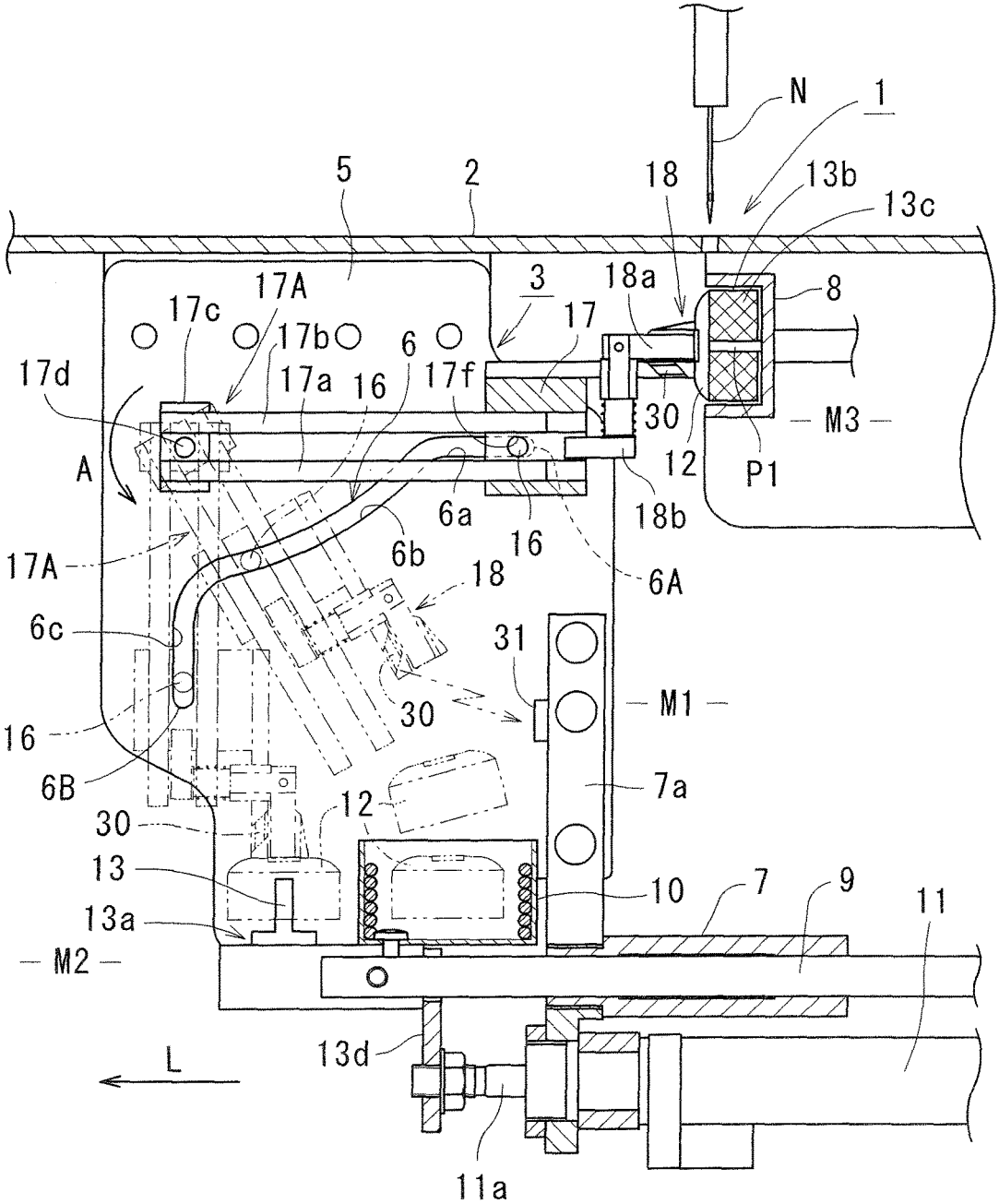
FIG. 14 is a longitudinal cross sectional view of the automated bobbin exchanger device according to a third embodiment of the invention.
Figure 15:
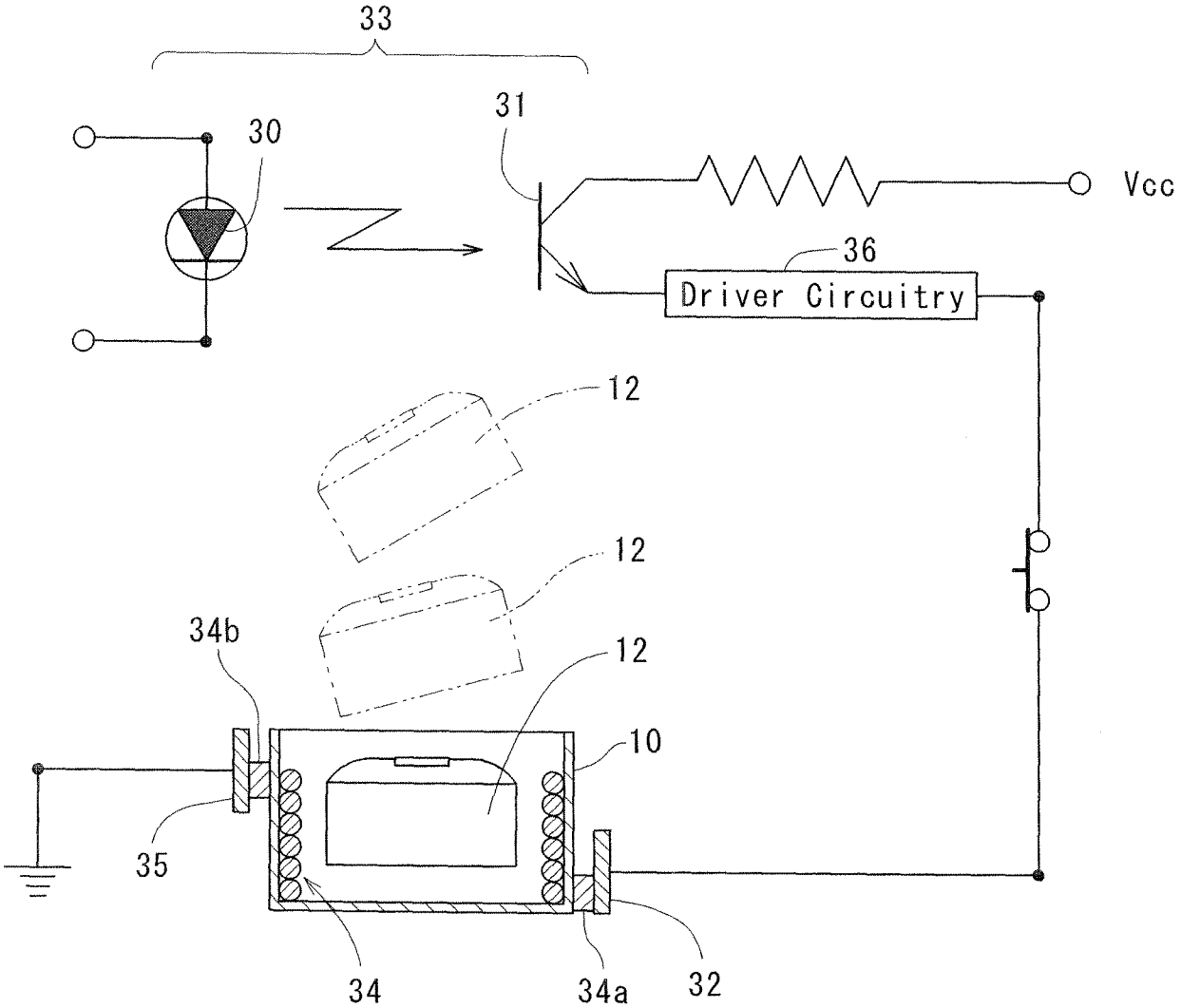
FIG. 15 is an electronic circuitry including a photocoupler having a light emitting element and a photo element.

FIGS. 14 and 15 show a third embodiment of the invention in which a light emitting element 30 is secured to the bobbin head 18*a*, and a photo element 31 is mounted on a first sliding plate 32 extended from the vertical fixing tool 7*a*.

The light emitting element 30 and the photo element 31 constitute a photo-coupler 33, and the light rays from the light emitting element 30 is usually shielded by the bobbin case 12 to prevent the light rays from reaching the photo element 31. At the time when the bobbin chuck 18 takes the bobbin case 12 off from the rotary hook 8, and moves back to the middle position M1 to release the bobbin case 12 toward the catch box 10, the light rays from the light emitting element 30 are adapted to reach the photo element 31.

To an inner wall of the catch box 10, a coiled body 34 is secured in contact with the catch box 10 as shown in FIG. 15. It is to be noted that the coiled body 34 may be secured to an outer surface of the catch box 10.

One end of the coiled body 34 has a positive terminal 34*a* extended outside to be in slidable contact with the first sliding plate 32. The other end of the coiled body 34 has a negative terminal 34*b* extended outside to be in slidable contact with a second sliding plate 35. The second sliding plate 35 is mounted on a stationary component part (not shown).

The negative terminal 34*b* is connected to the light emitting element 30 via the second sliding plate 35, and the photo element 31 is connected to the positive terminal 34*a* via the first sliding plate 32. As far as the layout in FIG. 14 is concerned, the first sliding plate 32 is located in a front-and-behind (obverse-and-reverse) relationship with the second sliding plate 35.

Upon actuating the transfer air-cylinder 11 to protract the rod 11*a* in the crosswise direction L so as to carry the catch box 10 outside, the positive terminal 34*a* is arranged to move away from the first sliding plate 32, and the negative terminal 34*b* arranged to move away from the second sliding plate 35.

At the time when the bobbin chuck 18 pivotably moves to the middle position M1 from the exchangeable position M3 so as to release the bobbin case 12 toward the catch box 10, the light shield is cleared so that the light rays from the light emitting element 30 reaches the photo element 31. For this reason, the photo-coupler 33 is energized via a driver circuitry 36 to draw an electric current through the coiled body 34. This enables the coiled body 34 to establish an electromagnetic force exerting against the bobbin case 12. The electromagnetic force attracts the bobbin case 12 to guide it into the catch box 10 at the middle position M1 without let and hindrance.

It is to be appreciated that the words related to "pivotably move", "rotate", "return", "pivotably rotate" and "move back" described herein are considered to be categorically identical in the contextual sense.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

What is claimed is:

1. An automated bobbin-exchanger device comprising:

a bobbin holder having a holder pin, to which a single bobbin case is detachably secured, said bobbin case being made of a magnetic material and said bobbin holder being placed under a rotary hook in which a hook pin is provided;

a vertical transfer base placed to depend from a sewing table;

a guide groove provided as a cammed groove piercingly on said vertical transfer base, said guide groove having a horizontal portion, a vertical portion and an arcuate portion, said arcuate portion being in communication with an interface between said horizontal portion and said vertical portion;

a chuck-drive lever pivotably provided by a pivot pin under said guide groove, a leading end of said chuck-drive lever having a forked portion in which a chuck pin is slidably provided, said chuck pin passing through said guide groove, said chuck-drive lever being arranged to pivotably rotate around said pivot pin to move said chuck pin reciprocally along said guide groove;

a bobbin chuck connected to said chuck pin and provided to detachably hold said bobbin case placed within said bobbin holder;

a chuck driver placed to pivotably move said chuck-drive lever reciprocally around said pivot pin between a standby position, an exchangeable position and a middle position, said standby position placing said chuck pin slidably within said vertical portion in which said bobbin chuck takes said bobbin case off from said bobbin holder, said exchangeable position placing said chuck pin slidably within said horizontal portion to secure said bobbin case to said rotary hook, said middle position placing said chuck pin slidably between said standby position and said exchangeable position;

a catch box placed to correspond to said middle position, to which said chuck-drive lever pivotably moves;

a chuck controller provided to pivotably move said bobbin chuck from said middle position to said exchangeable position through said horizontal portion so as to take said bobbin case off from said rotary hook, and pivotably moving back to said middle position with said bobbin case attached, and detaching said bobbin case therefrom at said middle position to let said bobbin case fall into said catch box, and thereafter pivotably moving said bobbin chuck further to said standby position through said vertical portion to take said bobbin case off from said bobbin holder and still further pivotably moving back to said exchangeable position through said arcuate portion and said horizontal portion so as to secure said bobbin case to said rotary hook before returning to said middle position through said horizontal portion;

a coiled body secured to an inner wall of said catch box and energized when said bobbin chuck detaches said bobbin case at said middle position so as to attract said bobbin case toward said catch box by means of an electromagnetic force established when said coiled body is energized; and a transfer air-cylinder mounted on said vertical transfer base to move said catch box outside across said vertical transfer base after said bobbin chuck let said bobbin case fall into said catch box.

2. An automated bobbin-exchanger device according to claim 1, wherein said bobbin case has an elastic lock lever movably provided by means of a chuck air-cylinder and said bobbin chuck having a chuck pawl removably engaged with said lock lever to detachably hold said bobbin case.

3. An automated bobbin-exchanger device according to claim 1, wherein said vertical transfer base has a rod movably provided to protract and retract by means of a drive air-cylinder, said drive air-cylinder protracting said rod to engage with one side of said chuck-drive lever to prevent said chuck-drive lever from inadvertently moving pivotably toward said standby position when said bobbin chuck pivotably returns to said middle position from said exchangeable position after securing said bobbin case to said rotary hook.

4. An automated bobbin-exchanger device according to claim 1, wherein said vertical transfer base secures a drive air-cylinder which has a rod movably provided to protract and retract, said chuck-drive lever having a stopper hole, said drive air-cylinder protracting said rod to engage with said stopper hole to prevent said chuck-drive lever from inadvertently shifting pivotably toward said standby position when said bobbin chuck pivotably returns to said middle position from said exchangeable position after securing said bobbin case to said rotary hook.

5. An automated bobbin-exchanger device according to claim 1, wherein said chuck-drive lever has an open-ended groove in a lengthwise direction, said groove having an inner side, along which said chuck pin is slidably arranged.

* * * * *